US012129741B2

(12) United States Patent
Soerheim et al.

(10) Patent No.: US 12,129,741 B2
(45) Date of Patent: Oct. 29, 2024

(54) METHOD AND APPARATUS FOR MAKING A LATERAL WELL

(71) Applicant: CONOCOPHILLIPS COMPANY, Houston, TX (US)

(72) Inventors: Jan Ove Soerheim, Tananger (NO); Tollef Svenum, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 118 days.

(21) Appl. No.: 17/668,562

(22) Filed: Feb. 10, 2022

(65) Prior Publication Data

US 2022/0268128 A1 Aug. 25, 2022

Related U.S. Application Data

(60) Provisional application No. 63/152,149, filed on Feb. 22, 2021.

(51) Int. Cl.

| | |
|---|---|
| ***E21B 41/00*** | (2006.01) |
| ***E21B 7/06*** | (2006.01) |
| ***E21B 34/06*** | (2006.01) |
| ***E21B 43/10*** | (2006.01) |

(52) U.S. Cl.

CPC ..... *E21B 41/0035* (2013.01); *E21B 7/06* (2013.01); *E21B 7/061* (2013.01); *E21B 34/06* (2013.01); *E21B 43/10* (2013.01)

(58) Field of Classification Search

CPC ..... E21B 41/0035; E21B 7/06; E21B 7/061; E21B 34/06; E21B 43/10

See application file for complete search history.

(56) References Cited

U.S. PATENT DOCUMENTS

| | | | | |
|---|---|---|---|---|
| 5,462,120 | A | 10/1995 | Gondouin | |
| 5,531,270 | A | 7/1996 | Fletcher et al. | |
| 6,047,774 | A | 4/2000 | Allen | |
| 2004/0092404 | A1* | 5/2004 | Murray | E21B 29/06 507/100 |
| 2010/0147592 | A1* | 6/2010 | Hearn | E21B 7/061 175/61 |
| 2011/0011580 | A1 | 1/2011 | Clark et al. | |
| 2016/0145956 | A1 | 5/2016 | Dahl et al. | |
| 2016/0305221 | A1 | 10/2016 | Hearn et al. | |
| 2019/0003258 | A1* | 1/2019 | Klam | E21B 34/102 |
| 2019/0010786 | A1* | 1/2019 | Durst | E21B 41/0042 |

OTHER PUBLICATIONS

International Search Report for PCT/US2022/015955 mailed Apr. 28, 2022; 4 pgs.

* cited by examiner

*Primary Examiner* — George S Gray

(74) *Attorney, Agent, or Firm* — CONOCOPHILLIPS COMPANY

(57) ABSTRACT

A method for installing a dual/multiple lateral well where the overburden casing is relatively narrow includes drilling a single diameter bore for the first lateral and employing a tapered liner. The liner has a narrow production section (109) and a larger diameter proximal section (104). A hollow whipstock (113) is run into the well and a window is milled in the proximal section (104) of the tapered liner, allowing a branched lateral B (115) to be drilled and then a liner (116) run through it.

12 Claims, 2 Drawing Sheets

METHOD AND APPARATUS FOR MAKING A LATERAL WELL

CROSS-REFERENCE TO RELATED APPLICATIONS

This application is a non-provisional application which claims benefit under 35 USC § 119(e) to U.S. Provisional Application Ser. No. 63/152,149 filed Feb. 22, 2021 entitled "METHOD AND APPARATUS FOR MAKING A LATERAL WELL," which is incorporated herein in its entirety.

STATEMENT REGARDING FEDERALLY SPONSORED RESEARCH

None.

FIELD OF THE INVENTION

This invention relates to the drilling and completing of oil and gas wells, specifically lateral wells which include a branched well.

BACKGROUND OF THE INVENTION

It is increasingly common when drilling wells into hydrocarbon reservoirs for the well to extend laterally within the reservoir and for one or more additional wells to be drilled, branching off from the main well and extending laterally within the reservoir.

A current method, suitable for subsea wells, is to drill a relatively large diameter borehole through the overburden rock above the reservoir, and then case this bore. Drill string with a drilling BHA (bottom hole assembly) is then passed down through the casing and a narrower, but still quite large (e.g. 9½") bore is then drilled into the reservoir. A reasonably large diameter liner (e.g. 8⅝") is then run into the reservoir bore and cemented in place.

A drilling BHA is then passed down again and a smaller diameter bore drilled at the end of the lined bore in the reservoir ("lateral A"). A relatively narrow (e.g. 5") production liner fitted with completion equipment and a liner hanger is then run into the narrower bore. The hanger is set in the 8⅝" liner. The production liner is then completed; in a chalk/limestone reservoir this would be by passing acid through perforations in the production liner.

A valve is then closed to seal off the production liner before a hollow whipstock is run into the 8⅝" liner to provide support for milling a side window in the 8⅝" liner. A milling tool is run into the well and a side window milled away, then a drilling BHA is run in and a second narrow bore ("lateral B") drilled into the reservoir through the window. A narrow (e.g. 5") production liner is then run into this second narrow reservoir bore, and the production liner completed as before. The relatively large diameter of the 8⅝" liner makes it relatively simple to create lateral wells with 5" liner.

The valve in lateral A is opened, normally being dissolved acid during the completion procedure in lateral B, and the well is then produced from both laterals.

The above procedure involved a considerable number of trips into and out of the well, each of which takes up expensive drilling rig time. Any way of reducing the number of trips is desirable.

In certain wells (e.g. the applicant's wells in the North Sea), the existing casing in the overburden is of relatively narrow diameter, e.g. 8⅝". If working with an existing well to drill multilaterals, this can present difficulties. Even if a new well is drilled with the intention to create multilaterals, the use of narrower casing in the overburden may have operational and cost advantages and may therefore be preferred. Also, generally, there is a desire to minimize the number of trips in a drilling operation, to save costs.

These considerations give rise to a need for an improved process for drilling multilateral wells.

BRIEF SUMMARY OF THE DISCLOSURE

The invention more particularly includes a process for drilling a multi-lateral well, where the process comprises:

a) drilling a first bore of a first bore diameter through overburden rock above a reservoir and casing the bore;

b) drilling a second bore of a second, smaller, bore diameter through the first bore and into the reservoir;

c) running into the bores an assembly comprising:

i) a liner hanger;

ii) a tapered liner having a first section with a first liner outer diameter and a second section with a second, smaller liner outer diameter;

iii) a whipstock nipple and valve in the first section of the liner;

iv) completion equipment installed in the second section of the liner;

whereby the liner hanger is anchored in the first bore and the first and second sections of liner extend into the second bore;

d) performing a completion operation in the second section of liner;

e) running a whipstock into the first section of liner and milling a window in the first section of liner, adjacent the whipstock;

f) drilling a branched, third bore through the window, running into the third bore a second liner and performing a completion operation in the second liner.

The process may be used when the reservoir is a chalk reservoir and it may be used where the liners are cemented in place. The invention is especially applicable in these cases because acid stimulation is used in chalk reservoirs where cemented liners tend to be used and for this procedure it is necessary to isolate lateral A after stimulation and before drilling lateral B.

The casing in the first bore may have an inner diameter of less than 9 inches, such as between 7 and 9 inches, e.g. about 8½ inches. The first liner outer diameter may be less than 8 inches, such as between 5 and 8 inches, e.g. about 7¾ inches. The second liner outer diameter may be less than 6 inches, such as between 4 and 6 inches, e.g. about 5 inches. In these situations where the diameter of the casing and liner is somewhat smaller than normal, the invention is particularly beneficial because of the restricted space.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
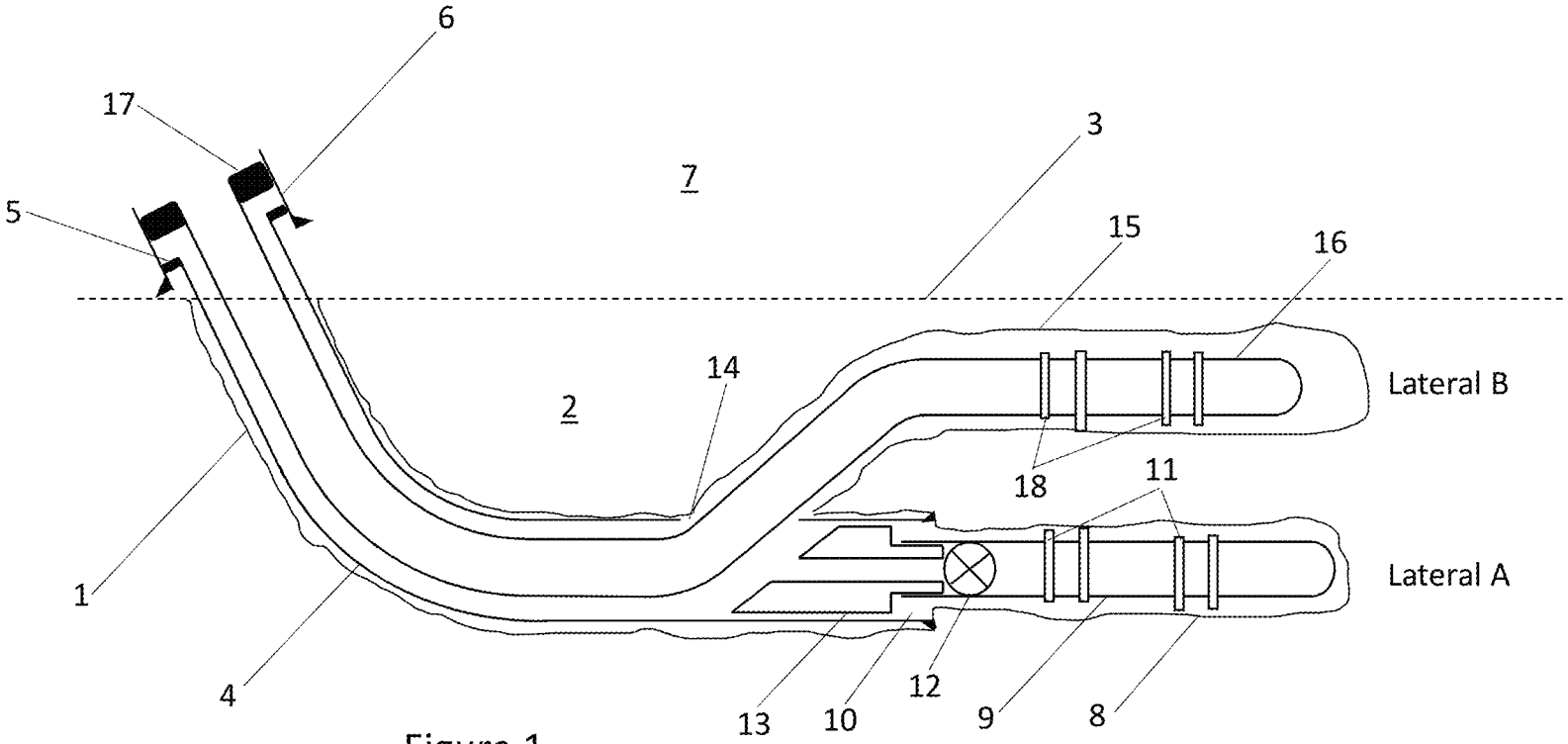
Figure 1 (Prior Art)
FIG. 1 (Prior Art) is a schematic section through a dual lateral well installed using a technique according to the prior art.

In order to aid understanding of the invention a technique according to the prior art is first described, with reference to FIG. 1. A solution to drilling multilateral wells exists, and is proven, by drilling a 9½"×11¼" bore 1 such that it extends laterally into the hydrocarbon-bearing reservoir 2 (represented in FIG. 1 as the region beneath the broken line 3) and setting an 8⅝" expandable liner 4 in the bore. The 8⅝" liner 4 is hung from a liner hanger 5 set in large diameter casing 6 in the overburden rock 7 (the region above the broken line 3). The term 9½"×11¼" is understood to mean a 9½" drilled bore which is then under-reamed to 11¾".

In the procedure, an 8½" bore 8 is then drilled into rock at the end of the 8⅝" liner, and a 5" production liner 9 run into the bore 8. The liner 9 is hung from a liner hanger 10 set at the end of the 8⅝" liner. The production liner 9 is then completed by injecting acid through perforations 11 in the liner 9. A ball valve 12 is then closed to shut off the liner 9. This completed part of the well is known as "Lateral A".

A hollow whipstock 13 is then run into the 9½" bore 1 and set adjacent the 5" production liner hanger 10. A milling tool is then run into the well and a window 14 milled in the 8⅝" liner 4. A drilling BHA is then run into the well and a second 8½" bore 15 is then drilled through the window 14 into the rock. A second 5" liner 16 is then run into the second 8½" bore 15 and hung from a liner hanger 17 set in the large diameter casing 6 in the overburden. The second production liner 16 is then completed via perforations 18. This second completed part of the well is known as "Lateral B".

Both laterals may now be put on production.

This procedure involves a large number of runs into the well and is also challenging to perform when an 8⅝" casing has been set in the overburden so that it is only possible to set a liner of less than 8⅝" diameter in the reservoir.

A procedure according to the invention is now described which involves fewer runs into the well and is more suitable for a scenario where it is not possible to set a 8⅝" liner in the reservoir.

On the applicant's wells in the North Sea, 8⅝" casing is utilized in the overburden, and hence is not always an available option in the reservoir.

A solution proposed by the inventors is to install a tapered liner, typically 7¾" or 7⅝", tapering to 5" or 4.5". The 7¾" or 7⅝" section may accommodate components to stimulate, and later temporarily isolate the 5" section below. This section may also accommodate a nipple for a whipstock to enable sidetracking. The liner hanger for the tapered liner can be installed in either an 8⅝" section, a 9⅝" section or in a 10¾" section of casing in the overburden. The 5" liner below the 7¾" or 7⅝" section may be stimulated and isolated temporarily. A whipstock may then be installed in the 7¾" or 7⅝" section; a window may be milled before drilling of an additional lateral well, typically with a 6½" bit to accommodate a 5" liner.

The proposed design can be run, for example, in any scenario where the restricting inner diameter is less than 9½" above the reservoir, but is not limited to this and can be beneficial for any size of overburden casing.

In this way the multilateral system is more flexible and can be utilized with more restrictive inner diameters above the reservoir. It is also more efficient as the liner to serve as junction is run in combination with the first branch's reservoir liner, rather than a "dedicated parent liner".

Figure 2:
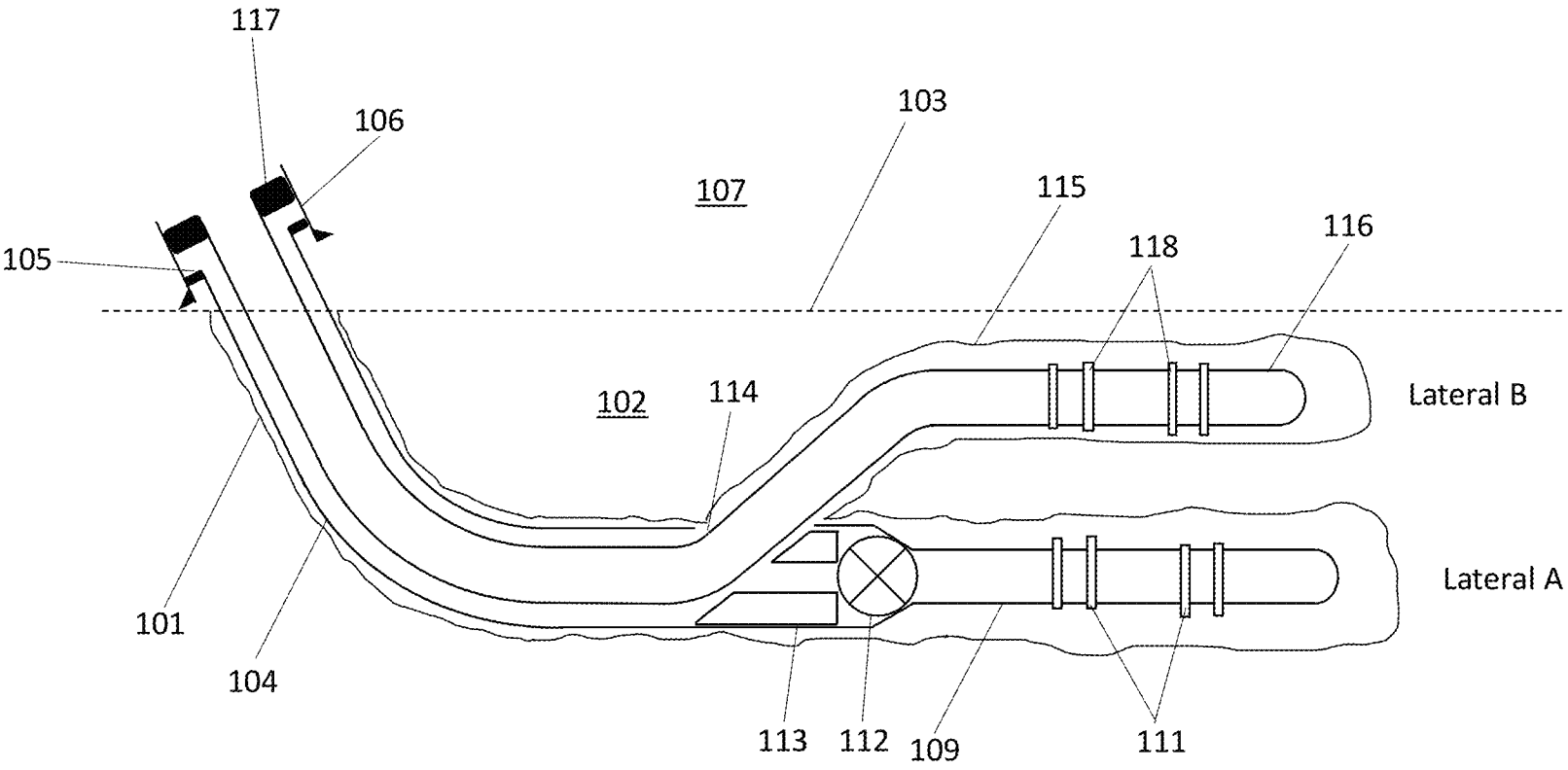
FIG. 2 is a schematic section through a dual lateral well installed using a technique according to the invention.

FIG. 2 illustrates a system according to the invention. Parts corresponding to those shown in FIG. 1 are designated by the same number but in the 100s series, thus numeral 117 refers to a liner hanger, numeral 111 refers to completion perforations in the narrow section of the tapered liner 104 and numeral 118 refers to completion apertures in liner 115. The overburden casing 106 immediately above the reservoir 102 is 8⅝" or 9⅝ casing. In this procedure a bore 101 is drilled into the reservoir 102 with perhaps an 8½" drill bit, all the way to the desired end point (TD) of a first lateral well (Lateral A). Optionally, the bore may be under-reamed up to 9½.

A tapered liner is then run into the bore 101, the tapered liner having a 7¾" section 104 and a 5" production section 109. The liner is pre-fitted with completion equipment and one or more valves 112 as well as a nipple (not shown) for receiving a whipstock.

The liner is cemented in place and then completed and stimulated, and then the valve 112 closed.

In the method described above, Lateral A is completed with a saving of at least two runs into the hole, with associated time and expense. Compared to the prior method at least one two runs into the well are avoided: one drilling run and one run to set a liner. The need to set a liner hanger to support the production liner for Lateral A is avoided. In the narrower well in which the system operates, there is less space for setting a liner, so that this step can be problematic. In the method according to the invention, the need to set a liner hanger for Lateral A is avoided. This also saves time and equipment cost.

After Lateral A is completed, a hollow whipstock 113 may then be run into the well and installed at the far end of the 7¾" liner section 104. The hollow whipstock includes a fluid loss valve (not shown), and is used to close off Lateral A during drilling and completion of Lateral B. After completion of Lateral B the valve will be opened to allow Lateral A to come onto production.

The procedure from this point is similar to the known procedure described above with reference to FIG. 1. A milling tool is run into the well and a side window 114 milled in the 7¾" section 104. A 6½" bore 115 may be drilled into reservoir rock by passing a suitable drill bit through the milled window 114. A 5" liner is then run into the well, through the window 114 and into the 6½" bore 115. Completion is then performed and Lateral B is thus established. Production may then commence from both laterals.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process for drilling a multi-lateral well, where the process comprises:

a) drilling a first bore of a first bore diameter through overburden rock above a reservoir and installing casing in the bore;

b) drilling a single diameter second bore of a second, smaller, bore diameter through the first bore and into the reservoir all the way to a desired end point of a first lateral well;

c) running into the bores, in a single run, an assembly comprising:

i) a tapered liner having a first, proximal, section with a first outer diameter and a second, distal, section with a second, smaller outer diameter;

ii) a liner hanger to which a proximal end of the first section of the tapered liner is mounted, said liner hanger being installed in overburden rock of the first bore;

iii) a whipstock nipple and valve in the first section of the tapered liner, at a distal end thereof;

iv) completion equipment installed in the second section of the tapered liner; whereby the liner hanger is anchored in the first bore and the first and second sections of the tapered liner extend into the second bore and no liner hanger is required in the reservoir for the second bore;

d) performing a completion operation in the second section of the tapered liner;

e) running a whipstock into the first section of the tapered liner and milling a window in the first section of the tapered liner, adjacent the whipstock;

f) drilling a branched, third bore through the window, running into the third bore a second liner and performing a completion operation in the second liner.

2. The process according to claim 1, wherein the reservoir is a chalk reservoir.

3. The process according to claim 2, wherein the liners are cemented in place.

4. The process according to claim 1, wherein the casing in the first bore has an inner diameter of less than 9 inches.

5. The process according to claim 1, wherein the casing in the first bore has an inner diameter of between 7 and 9 inches.

6. The process according to claim 1, wherein the casing in the first bore has an inner diameter of about 8½ inches.

7. The process according to claim 1, wherein the outer diameter of the first section of the tapered liner is less than 8 inches.

8. The process according to claim 1, wherein the outer diameter of the first section of the tapered liner is between 5 and 8 inches.

9. The process according to claim 1, wherein the outer diameter of the first section of the tapered liner is about 7¾ inches.

10. The process according to claim 1, wherein the outer diameter of the second section of the tapered liner is less than 6 inches.

11. The process according to claim 1, wherein the outer diameter of the second section of the tapered liner is between 4 and 6 inches.

12. The process according to claim 1, wherein the outer diameter of the second section of the tapered liner is about 5 inches.

* * * * *